US009341154B2

(12) United States Patent
Romeo et al.

(10) Patent No.: US 9,341,154 B2
(45) Date of Patent: May 17, 2016

(54) VALVE ASSEMBLY FOR A FUEL INJECTOR AND FUEL INJECTOR

(71) Applicant: Continental Automotive GmbH, Hannover (DE)

(72) Inventors: Ileana Romeo, Grossetto (IT); Matteo Soriani, Leghorn (IT); Francesco Lenzi, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 64 days.

(21) Appl. No.: 14/249,724

(22) Filed: Apr. 10, 2014

(65) Prior Publication Data

US 2015/0292461 A1 Oct. 15, 2015

(51) Int. Cl.

| | |
|---|---|
| ***F02M 51/00*** | (2006.01) |
| ***F02M 61/18*** | (2006.01) |
| ***F02M 61/20*** | (2006.01) |
| ***F02M 51/06*** | (2006.01) |
| ***B05B 1/30*** | (2006.01) |
| ***F02M 61/12*** | (2006.01) |
| ***F02M 61/16*** | (2006.01) |

(52) U.S. Cl.

CPC ..... *F02M 61/1893* (2013.01); *B05B 1/3046* (2013.01); *F02M 51/061* (2013.01); *F02M 61/12* (2013.01); *F02M 61/166* (2013.01); *F02M 61/18* (2013.01); *F02M 61/20* (2013.01); *F02M 61/205* (2013.01)

(58) Field of Classification Search

CPC ..... F02M 61/18; F02M 61/20; F02M 51/061; F02M 61/1893; F02M 61/12; F02M 61/166; F02M 61/205; B05B 1/3046

USPC ..... 239/533.3, 533.9, 584, 585.1, 585.4, 239/585.5

See application file for complete search history.

(56) References Cited

U.S. PATENT DOCUMENTS

| | | | | |
|---|---|---|---|---|
| 6,279,842 | B1 * | 8/2001 | Spain | 239/585.1 |
| 6,367,769 | B1 * | 4/2002 | Reiter | 239/585.5 |
| 6,520,434 | B1 | 2/2003 | Reiter | 239/585.5 |
| 2001/0015417 | A1 | 8/2001 | Ricco et al. | 251/129.16 |

FOREIGN PATENT DOCUMENTS

| | | | | |
|---|---|---|---|---|
| EP | 0851116 | A2 | 7/1998 | F02M 47/100 |
| EP | 1845254 | A1 | 10/2007 | F02M 51/06 |
| EP | 2706221 | A1 | 3/2014 | F02M 51/06 |
| WO | 00/79120 | A1 | 12/2000 | F02M 51/06 |

OTHER PUBLICATIONS

European Search Report, Application No. 2706221 A1, 2 pages, Feb. 7, 2013.

* cited by examiner

*Primary Examiner* — Steven J Ganey

(74) *Attorney, Agent, or Firm* — Slayden Grubert Beard PLLC

(57) ABSTRACT

A valve assembly includes a valve body, a movable valve needle, a movable armature, and an elastic member. The armature is axially moveable with respect to the needle so that, when the needle is in the closing position, the armature is movable from a first position further in the second direction to a second position against the bias of the elastic member. The elastic member has a plurality of beams, each beam having a first end and a second end which are axially and radially offset with respect to each other, and the armature is operable to reduce the axial offset between the first end and the second end when moving from the first to the second position.

18 Claims, 3 Drawing Sheets

120
10
140
50
220
102
30
110
410
420
40
101
20
210
150
130
L
1
D1
D2
4110
4120
4130
$d_A$
$d_B$

VALVE ASSEMBLY FOR A FUEL INJECTOR AND FUEL INJECTOR

TECHNICAL FIELD

The present disclosure relates to a valve assembly for a fuel injector and to a fuel injector.

BACKGROUND

Fuel injectors may be used for example in internal combustion engines for dosing fuel into an intake manifold of the internal combustion engine or directly to the combustion chamber of a cylinder of the internal combustion engine. The fuel injectors may be operable to dose the fuel under high pressures, for example in the range of up to 200 bar in the case of gasoline engines and of 2000 bar or more in the case of diesel engines.

SUMMARY

One embodiment provides a valve assembly for a fuel injector comprising a valve body having a longitudinal axis, a valve needle, an armature and an elastic member, the valve needle and the armature being axially movable with respect to the valve body in a first direction and in a second direction, opposite the first direction, wherein the armature is biased in the first direction by means of the elastic member, the needle, when moving in the second direction to a closing position, is operable to mechanically interact with the armature for moving the armature in the second direction to a first position against the bias of the elastic member, the armature is axially moveable with respect to the needle so that, when the needle is in the closing position, the armature is movable from the first position further in the second direction to a second position against the bias of the elastic member, the elastic member has a plurality of beams, each beam having a first end and a second end which are axially and radially offset with respect to each other, the armature is operable to reduce the axial offset between the first end and the second end when moving from the first to the second position, the elastic member radially surrounds the needle and is formed in such fashion that the first ends of the beams are facing the needle and are arranged at a radial distance from the needle when the armature is in the first position, and the beams are elastically deformable in such fashion that the radial distance between the first ends and the needle decreases when the armature moves from the first to the second position.

In a further embodiment, the elastic member is made from stainless steel.

In a further embodiment, at least one of the first ends abuts the needle when the armature is in the second position.

In a further embodiment, the beams are arranged evenly spaced around the needle in a top view along the longitudinal axis.

In a further embodiment, the elastic member has the basic shape of a conical shell with an upper inner edge and a lower outer edge, the upper inner edge facing the armature and the lower outer edge residing against the valve body or vice versa.

In a further embodiment, the upper inner edge is discontinuous and is formed by the first ends of the beams.

In a further embodiment, the elastic member has a circumferential ring section, the ring section comprises the lower outer edge and the beams are anchored to the ring section at their second ends.

In a further embodiment, the elastic member is provided to bias the armature with a force in the first direction, the force being independent of an axial position of the armature.

In a further embodiment, the valve assembly is configured for dissipating kinetic energy of the armature when the armature is moving from the first towards the second position by means of mechanical interaction of the elastic member with the armature and/or the needle and/or the fuel.

Another embodiment provides a fuel injector comprising a valve assembly having any or all of the features disclosed above.

Another embodiment provides a valve assembly for a fuel injector comprising a valve body having a longitudinal axis, a valve needle, an armature and an elastic member, the valve needle and the armature being axially movable with respect to the valve body in a first direction and in a second direction, opposite the first direction, wherein the armature is biased in the first direction by means of the elastic member, the needle, when moving in the second direction to a closing position, is operable to mechanically interact with the armature for moving the armature in the second direction to a first position against the bias of the elastic member, the armature is axially moveable with respect to the needle so that, when the needle is in the closing position, the armature is movable from the first position further in the second direction to a second position against the bias of the elastic member, the elastic member has a plurality of beams, each beam having a first end and a second end which are axially and radially offset with respect to each other, the armature is operable to reduce the axial offset between the first end and the second end when moving from the first to the second position, and the elastic member has the basic shape of a conical shell with an upper inner edge and a lower outer edge, the upper inner edge facing the armature and the lower outer edge residing against the valve body or vice versa.

In a further embodiment, the elastic member is made of stainless steel.

BRIEF DESCRIPTION OF THE DRAWINGS

Example embodiments are discussed below with reference to the drawings, in which.

DETAILED DESCRIPTION

Figures 1, 2, 3:
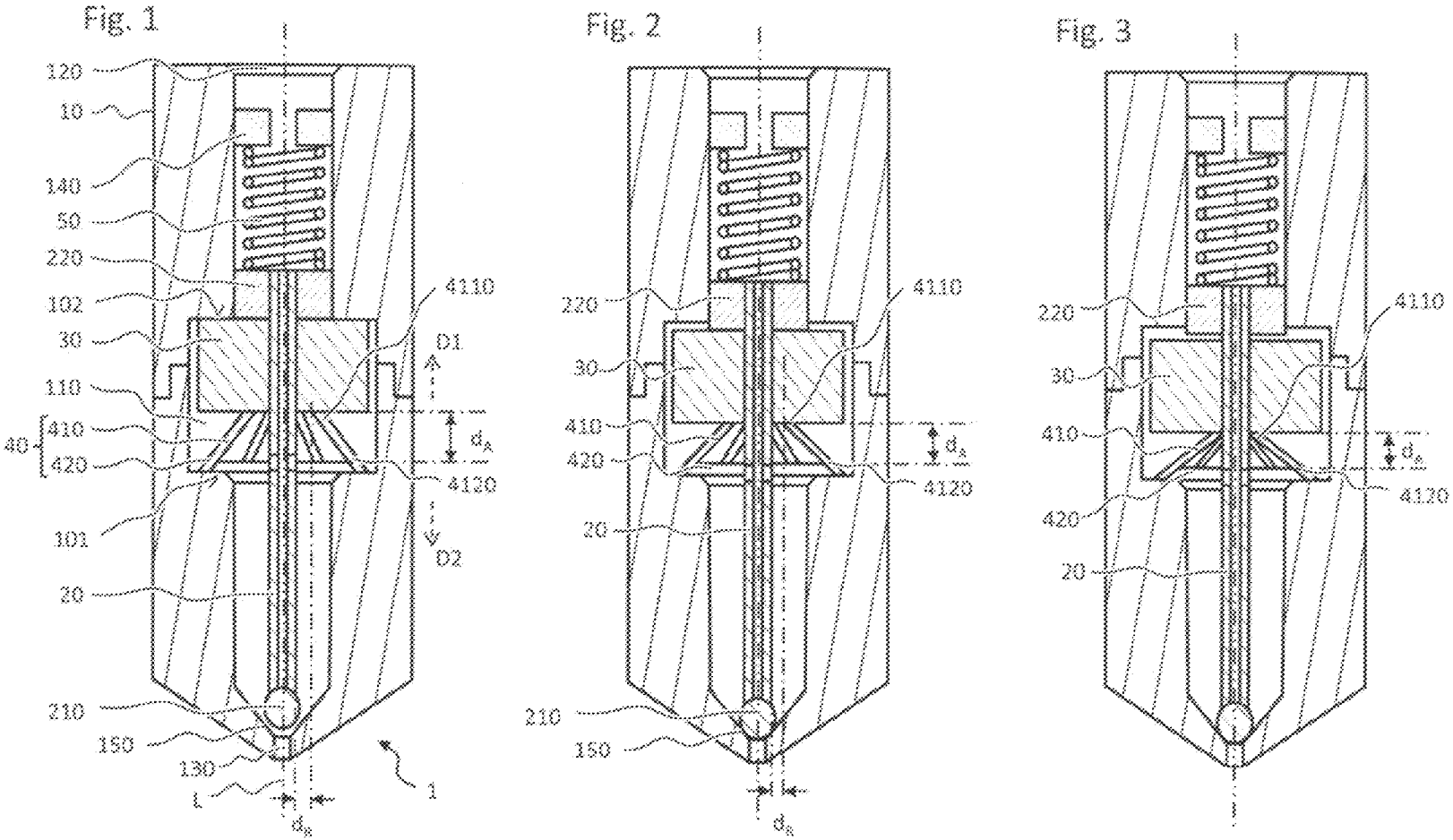
FIG. 1 shows a schematic cross sectional view of a valve assembly according to an exemplary embodiment in an opened state.
FIG. 2 shows a schematic cross section of the valve assembly of FIG. 1 in a closed state.
FIG. 3 shows the valve assembly of FIG. 2 in a further state during the closing event.

Embodiments of the present invention provide a valve assembly for a fuel injector and a fuel injector which allow particularly precise dosing of the fuel.

According to one aspect, a valve assembly for a fuel injector is specified. According to another aspect, a fuel injector is specified, the fuel injector having the valve assembly. The fuel may, for example, be one of gasoline, diesel, and/or ethanol.

The valve assembly comprises a valve body. The valve body has a longitudinal axis. The valve assembly further comprises a valve needle, an armature and an elastic member.

In one embodiment, the valve body has a cavity. The cavity may extend—in particular in longitudinal direction—from a fuel inlet opening of the valve body to a fuel outlet opening of the valve body. The fuel outlet opening may be comprised by an injection nozzle of the valve body. The valve needle and the armature may be preferably arranged in the cavity.

The valve needle is axially moveable in a first direction and in a second direction, opposite the first direction, with respect to the valve body. The needle is in particular axially moveable between a closing position and further positions, for example between a closing position and an opening position. The needle may have a tip, which in particular sealingly rests on a valve seat of the valve body when the needle is in the closing position in order to prevent fuel from leaving the valve assembly through the fuel outlet opening. The needle is for example axially moveable away from the closing position—in particular towards the opening position—in the first direction.

The armature is also axially moveable in the first and in the second direction with respect to the valve body. It is biased in the first direction by means of the elastic member. In other words, the elastic member exerts a force on the armature, the force being directed in the first direction.

The needle, when moving in the second direction to the closing position, is operable to mechanically interact with the armature for moving the armature in the second direction to a first position against the bias of the elastic member. In other words, the armature is coupled to the needle in such fashion, that the needle exerts a force in the second direction on the armature to move the armature in the second direction when the needle moves in the second direction to the closing position. The needle in particular takes the armature with it to the first position when it is moving in the second direction to the closing position. Expediently, the armature may reach the first position when the needle reaches the closing position.

For example, the needle has a flange—sometimes also called a collar—which is operable to transfer a force to the armature in the second direction. The flange may be manufactured separately from a main barrel or cylinder of the needle and rigidly fixed to the barrel or cylinder so that relative axial movement is prevented. For example, the flange may abut the armature when the needle is moving in the second direction. The flange and the elastic member may in particular be arranged on opposite sides of the armature.

In one embodiment, the valve assembly comprises a spring which is operable to exert a force on the needle for moving the needle in the second direction to the closing position. The needle may expediently be biased with a given force in the second direction when it is in the closing position, for example by means of the spring.

The armature is in particular operable to interact mechanically with the needle to move the needle in the first direction, away from the closing position and in particular towards the opening position, when the armature moves in the first direction from its first position. For example, the armature interacts with the needle via the flange.

The armature is also axially moveable with respect to the needle so that, at least when the needle is in the closing position, the armature is moveable from the first position further in the second direction to a second position against the bias of the elastic member.

The elastic member has a plurality of beams. Each beam has a first end and a second end. The first end and the second end of each beam are axially offset with respect to each other. The first end and the second end of each beam are also radially offset with respect to each other. The beams in particular extend obliquely with respect to the longitudinal axis. The main extension directions of the beams in top view along the axis are in particular radial directions, having the longitudinal axis as a center.

The armature is operable to reduce an axial offset between the first end and the second end of each beam when it is moving from the first to the second position. In particular, the armature is operable to bend the beams when moving from the first towards the second position. In this way, the armature is operable to compress the elastic member.

In one embodiment, the valve assembly is configured for dissipating kinetic energy of the armature, when the armature is moving from the first towards the second position by means of mechanical interaction of the elastic member of the armature and/or the needle and/or the fuel. For example, the valve assembly may be configured to dissipate kinetic energy by means of at least one of the following: friction between the beams and the armature, friction between the beams and the needle, compression and/or displacement of fuel by means of deformation of the beams.

The elastic member may be made of a stainless steel, i.e. it comprises or consists of the stainless steel. In this way, a particularly good elasticity of the beams is achievable. In addition, the risk for abrasive damage by the friction between the beams and the armature or the needle, respectively, is particularly small.

When the valve assembly is operated for bringing the valve assembly from an opened state to a closed state—also referred to as closing event—, the needle is moved in the second direction to the closing position. For example, the needle is biased in the second direction by a spring which mechanically interacts with the needle to move it in the second direction towards the closing position during the closing event.

On its way to the closing position, the needle takes the armature with it in the second direction to the first position. When the needle has reached the closing position and the armature, consequently, has reached the first position, movement of the needle in the second direction may be stopped by interaction with the valve body. For example, the tip of the needle hits the valve seat when the needle reaches the closing position.

The armature reaches the first position with a certain velocity, corresponding to a given kinetic energy. Thus, since it is axially moveable with respect to the needle, the armature moves further in the second direction from the first position to the second position. Due to this movement against the bias of the elastic member, the elastic member is compressed by the deformation of the beams. In this way, the kinetic energy, which the armature has in the first position, is partially converted into a given potential energy of the elastic member. Another part of the kinetic energy is dissipated, for example by friction between the elastic member and the armature.

The armature comes to a rest when it has reached the second position. The compressed elastic member subsequently forces the armature to move back in the first direction to the first position.

The armature, when reaching the first position again, in particular mechanically interacts with the needle to transfer a force to the needle in the first direction. For example, the armature hits the flange of the needle when it returns to the first position. Since its kinetic energy has been partially dissipated by means of interaction with the elastic member, the force exerted by the armature on the needle during this armature-needle bounce is advantageously reduced. In this way, the danger is advantageously reduced that the valve reopens and that fuel is dispensed unintentionally through the fuel outlet opening. Therefore, a particularly precise dosing of the fuel is achievable.

In one embodiment, the elastic member is provided to bias the armature with a force in the first direction, the force being independent of an axial position of the armature. In other words, for example by means of the deformable beams, the spring force of the elastic member may be substantially or completely independent of the compression of the elastic member in axial direction. In particular it is substantially or completely independent of the axial offset of the first and the second ends at least under operating conditions of the valve assembly.

The operation of the valve assembly may be particularly reliable and reproducible in this way. For example, the valve assembly is particularly insensitive with respect to production tolerances or mounting tolerances of its constituent parts which may lead to different absolute values of the respective axial offset between the first and second ends of the beams.

In one embodiment, the elastic member radially surrounds the needle and is formed in such fashion that the first ends of the beams are facing the needle and are arranged at a radial distance from the needle when the armature is in the first position. The beams are preferably elastically deformable in such fashion, that the radial distance between the first ends and the needle decreases when the armature moves from the first towards the second position. In one development the first ends or at least one of the first ends abuts the needle when the armature is in the second position. In this way, particularly effective dissipation of the kinetic energy of the armature is possible by means of friction between the beams and the needle.

In one embodiment, the beams are arranged evenly spaced around the needle in a top view along the longitudinal axis. This allows for a well-balanced force distribution in angular direction around the longitudinal axis.

In one embodiment, the elastic member has the basic shape of a conical shell with an upper inner edge and a lower outer edge. The upper inner edge may face the armature. The lower outer edge may reside against the valve body. It is also conceivable that the upper inner edge resides against the valve body and the lower outer edge faces, and in particular abuts, the armature. The expressions "upper edge" and "lower edge" in particular refer to the position with respect to the tip of the cone of which the conical shell is a section. The upper edge adjoins the tip, while the lower edge is remote from the tip.

The upper inner edge of the conical shell may be discontinuous. It is expediently formed by the first ends of the beams. The elastic member, for example, has a plurality of beams and a plurality of slots. The beams and slots are arranged in angular direction around the longitudinal axis in alternating fashion, i.e. each two neighboring beams being separated from one another by one of the slots.

The elastic member may also have a circumferential ring section, which is in particular a continuous section that extends completely circumferentially around the longitudinal axis and—in top view along the longitudinal axis—around the beams. The ring section expediently comprises the lower outer edge. The beams may be anchored to the ring section at their second ends. For example, the beams and the ring section are formed as a one piece element and the beams merge with the ring section at their second ends.

FIGS. 1, 2 and 3 show a valve assembly according to an exemplary embodiment in an opened state (FIG. 1) in a closed state (FIG. 2) and in a state during the closing event (FIG. 3).

The valve assembly 1 comprises a valve body 10 having a longitudinal axis L. The valve body 10 comprises a cavity 110.

The cavity 110 extends through the valve body 10 in axial direction L from a fuel inlet opening 120 of the valve body 10 to the injection nozzle 130 of the valve body 10, the injection nozzle 130 having a fuel outlet opening.

In the cavity 110, a valve needle 20 is arranged. The needle 20 is axially moveable in the cavity 110 with respect to the valve body 10. The valve needle 20 has a tip 210 which faces the injection nozzle 130. The tip 210 may be, for example, ball-shaped. At its end remote from the injection nozzle 130 and facing the fuel inlet opening 120, the valve needle 20 has a flange 220. The flange 220 may be operable to guide the valve needle in the cavity 110. Between the tip 210 and the flange 220 the valve needle may, for example, comprise a tubular section. The tubular section may have a recess which is extending in axial direction L and which is bounded by a side wall of the tubular section. Openings may be provided in the side wall, so that fuel may flow through the recess to the outside of valve needle 20.

The valve assembly 1 further comprises an armature 30. The armature 30 is arranged in the cavity. In the present embodiment, it is ring-shaped with a central opening through which the valve needle 20 extends.

In addition, the valve assembly 1 comprises an elastic member 40. The elastic member 40 is made of stainless steel and radially surrounds the valve needle 20 and is arranged in the cavity 110 of the valve body 10. The elastic member 40 in this and other embodiments may comprise of at least one metal or consist of at least one metal or alloy.

Figure 4:
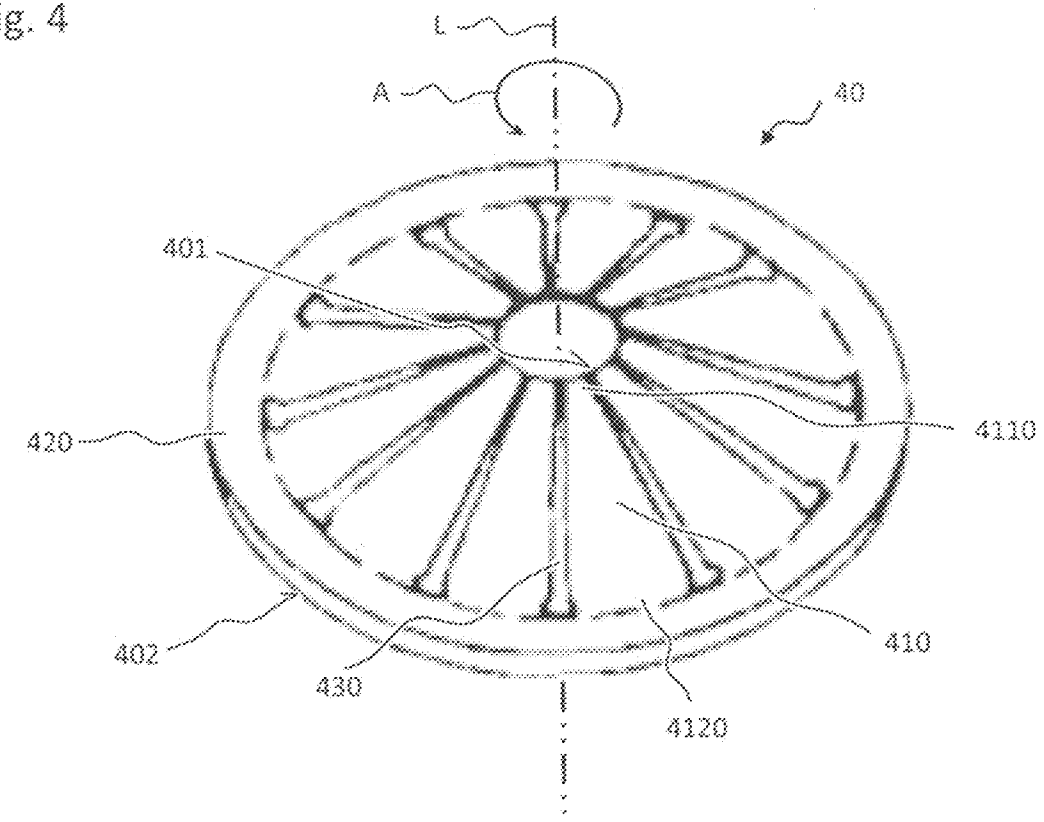
FIG. 4 shows the elastic member of the valve assembly of FIGS. 1, 2, and 3 in a perspective view.

FIG. 4 shows a schematic perspective view of the elastic member 40 of the present embodiment.

The elastic member 40 has the basic shape of a conical shell. It has an upper inner edge 401 and a lower outer edge 402. The upper inner edge 401 faces the armature 30 and the lower outer edge 402 resides against the valve body 10, specifically it resides against a first shoulder 101 of the cavity 110.

The lower outer edge 402 is comprised by a ring section 420. The ring section has its geometric center on the longitudinal axis L, for example. A main plane of extension of the ring section 420 may be arranged perpendicular to the longitudinal axis L. The ring section 420 extends completely circumferentially around the valve needle 20.

The elastic member 40 further has a plurality of beams 410, the beams emerging from the ring section 420 and extending to the upper inner edge 401. The beams 410 and the ring section 420 are formed as one piece in the present embodiment.

In particular, the upper inner edge 401 is represented by first ends 4110 of the beams 410. The first ends 4110 are in particular free ends of the beams 410. Each beam 410 also has a second end 4120 with which it is anchored with the ring section 420 and merges with the ring section 420. The first end 4110 of each beam 410 is axially offset from the second end 4120 of the beam 410 by a distance $d_4$.

The beams 410 are arranged uniformly around the needle 20 in a top view along the longitudinal axis L. In particular, the beams 410 are evenly spaced in an angular direction A—i.e. clockwise or counter clockwise—around the longitudinal axis L. In this way, slots 430 are formed between each two neighboring beams 410.

The elastic member 40 is operable to bias the armature 30 in a first axial direction D1 with respect to the valve body 10. For example, the elastic member 40 resides on the first shoulder 101 of the valve body with its lower outer edge 402 and the first ends 4110 of the beams 410 are elastically deformed so that they are pressed against the armature 30 to exert a force in the first direction D1.

The valve needle 20, on the other hand, is biased in a second direction D2 along the longitudinal axis L, the second direction D2 being opposite to the first direction D1, by a spring 50 of the valve assembly 1. The spring is pre-loaded—for example by means of a calibration element 140 of the valve assembly 1—so that the spring 50 is operable to exert a force in the second direction D2 on the valve needle.

In the closed state of the valve assembly 1 (see FIG. 2) the tip 210 of the needle is in a closing position. In the closing position, it resides against the valve seat 150 and is pressed against the valve seat 150 by means of the force exerted by the spring 50 on the needle 20 in the second direction D2.

The armature 30 is pressed against the flange 220 of the valve needle 20 by means of the bias exerted on the armature 30 in the first direction D1 by the elastic member 40. In this way, the armature 30 transfers a force in the first direction D1 on the valve needle 20.

When the valve assembly 1 is in the closed state, the magnitude of the force exerted by the spring 50 on the valve needle 20 in the second direction D2 exceeds the force transferred to the valve needle 20 in the first direction D1 by the armature 30 so that the tip 210 of the valve needle 20 is retained in its closing position residing against the valve seat 150. In this way, the injection nozzle 130 is sealed and fuel flow through the fuel outlet opening is prevented in the closed state of the valve assembly 1 as shown in FIG. 2.

In the following, a method for operating the valve assembly 1 is described in detail.

In order to move the needle away from the closing position (see FIG. 2) to further positions in particular to an opening position as shown in FIG. 1—the fuel injector may comprise an actuator assembly (not shown) provided for exerting an additional force in the first direction on the armature 30. For example, the actuator assembly is an electromagnetic actuator assembly comprising a solenoid for generating a magnetic force as the additional force. Such actuator assemblies are in principle known to the person skilled in the art and will not be described here in further detail. The magnitude of the additional force is selected such that the bias of the elastic member of 40 and the additional force of the actuator assembly together are operable to move the armature 30 in the first direction to the opening position against the bias of the spring 50.

When the actuator assembly is operated to generate the additional force, the armature 30 moves from its first position in the first axial direction D1 with respect to the valve body 10 and takes the valve needle 20 with it in the first direction D1 with respect to the valve body 10 by means of the mechanical interaction between the armature 30 and the flange 220—in the present embodiment by means of the form fitting connection of the armature 30 with the flange 220.

In this way, the valve needle 20 is axially moved out of the closing position, so that a gap is created between the tip 210 of the valve needle 20 and the valve seat 150. Fuel may flow from the fuel inlet opening 120 of the valve body 10 through the cavity 110—and in particular through the recess of the needle 20—and through the gap to the injection nozzle 130 and may be dispensed through the fuel outlet opening of injection nozzle 130.

Movement of the armature 30 in the first direction may be limited by means of a second shoulder 102 of the valve body 10, for example. In the opened state of the valve assembly 1, the armature 30 may reside against the second shoulder 102, for example. In this way, the armature 30 may retain the valve needle 20 the opening position by means of the mechanical interaction with the flange 220.

To initiate the closing event for bringing the valve from the opened state to the closed state, the actuator assembly may be turned off, so that the additional is no longer generated by the actuator assembly. Thus, the force of the spring 50 exerted on the valve needle 20 in the second direction D2 dominates and the spring 50 accelerates the needle 20 in the second direction D2.

By means of interaction via its flange 220, the valve needle 20 takes the armature 30 with it in the second direction D2 towards the first position against the bias of the elastic member 40. The armature 30 in particular moves away from the second shoulder 102 in the present embodiment.

When moving in the second direction D2, the armature elastically deforms the beams 410 of the elastic member 40. Due to the deformation caused by the armature 30, the axial distance $d_A$ between the first and second ends 4110, 4120 of each beam 410 decreases.

The movement of the valve needle 20 and the armature 30 in the second direction D2 continues until the valve needle 20 reaches the closing position, where the tip 210 contacts the valve seat 120. Further movement of the valve needle 20 is then prevented by the mechanical interaction with the valve body 10 so that the valve needle 20 comes to a rest in the closing position.

When the valve needle 20 reaches the closing position, armature 30 reaches its first position having a certain velocity corresponding to a first kinetic energy of the armature 30. The valve assembly 1 is configured in such way that the armature 30 is axially moveable in the second direction D2 with respect to the valve needle 20 and the valve body 10 from the first position. In particular, when the needle 20 has reached the closing position, armature 30 decouples from the flange 220 and moves further in the second direction D2 against the bias of the elastic member 40. The bias of the elastic member 40 slows down the armature 30 until it comes to a rest in a second position shown in FIG. 3. In the second position, the armature 30 is axially spaced from the flange 220 of the valve needle 20.

On the way from the first position to the second position, one portion of the first kinetic energy of the armature 30 is transferred to the elastic member 40 and increases the potential energy of the elastic member 40. Specifically, the axial offset between the first and second ends 4110 and 4120 of the beams 410 is further reduced as compared to a configuration of the valve assembly 1 when the armature 30 is in the first position (as in FIG. 2). Further, in the present embodiment the beams 410 are deformed by the armature 30 in such way, that also a radial distance $d_R$ of the first ends 4110 from the valve needle 20 decreases when the armature 30 moves in the second direction D2. When the armature 30 is in the second position, the first ends 4110 of the beams 410 are in direct contact with the needle, i.e. the radial distance $d_R$ equals 0.

Another portion of the first kinetic energy of the armature 30 is dissipated. Specifically, when the armature 30 moves from the first position to the second position, the first ends 4110 of the beams move radially with respect to the surface of the armature 30 which they abut. This movement involves friction between the first ends 4110 and the armature 30 so that kinetic energy of the armature is dissipated. Further, energy is dissipated by friction between the first ends 4110 and the needle 20 when the beams 410 reach the surface of the needle 20. Further, in particular due to the change in axial offset $d_A$ between the first and the second ends 4110, 4120, the beams 410 compress and displace fuel, for example towards the ring section 420, towards the first shoulder 101 of the valve body 10 and/or through the slots 430, which involves further dissipation of energy.

In this way, the first kinetic energy which the armature 30 has when it initially reaches the first position during the closing event is only partially transformed into potential energy of the elastic member. Rather, a portion of the kinetic energy is dissipated.

Figure 5:
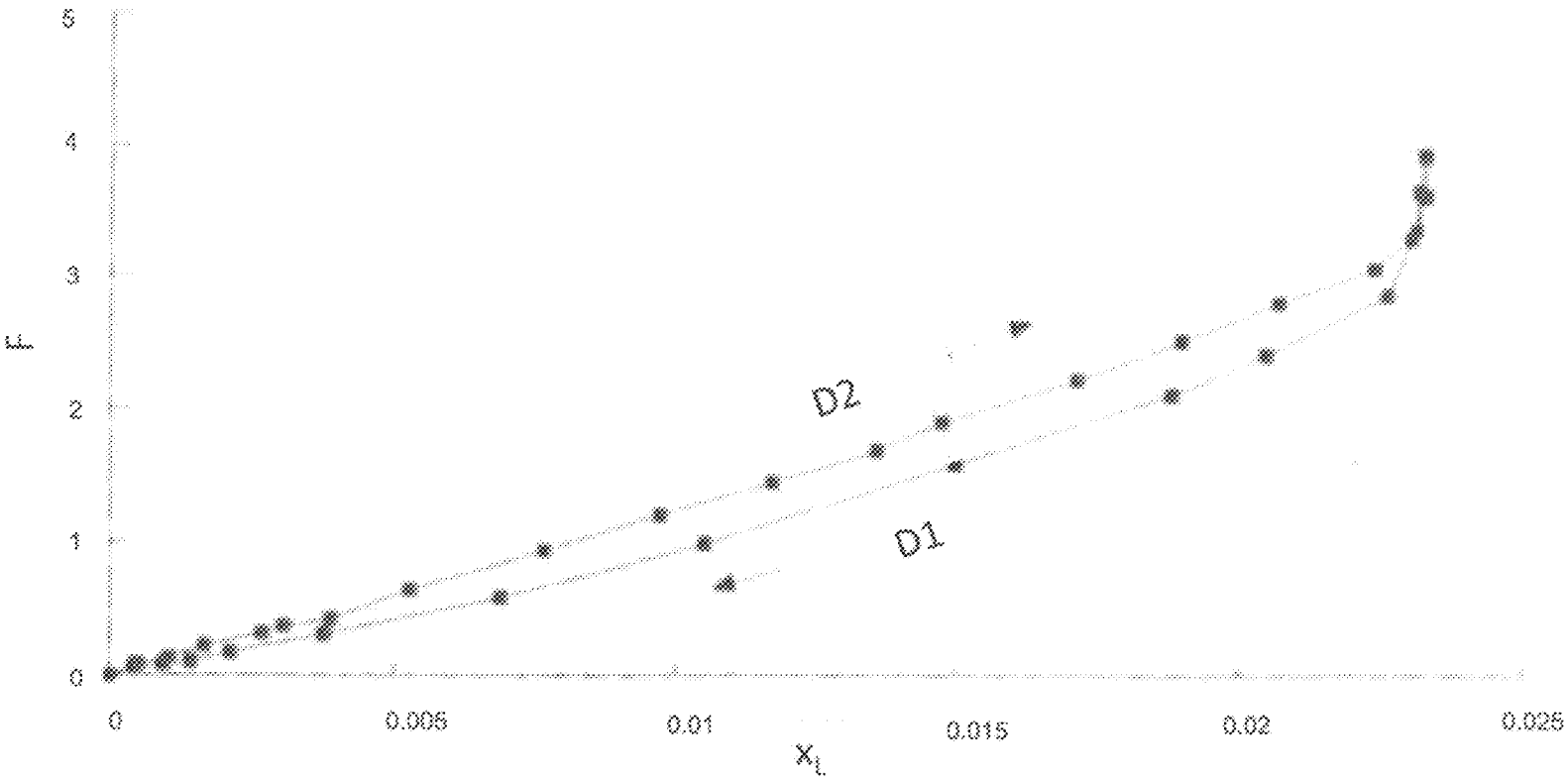
FIG. 5 shows the load—deflection curve of the elastic member of FIG. 4.

This hysteresis can be seen in FIG. 5 which shows the load deflection curve—sometimes also called stress-strain curve—of the elastic member 40.

A certain deflection $x_L$ of the elastic member 40 in longitudinal direction L corresponds to a larger force F when deflecting the in the second direction D2 than when deflecting in the first direction D1. This means that the energy required to compress the elastic member 40 by a certain axial distance is higher than the energy which the elastic member 40 sets free on relaxation by the same distance.

FIG. 5 also shows that the load deflection curve is basically linear over almost the complete deflection range. This means that the spring force depends only on the deflection difference, but not on the absolute value of the deflection. In this way, the valve assembly 1 is particularly insensible to mounting or manufacturing tolerances.

From the second position, driven by the bias of the elastic member 40, the armature 30 moves back in the first direction D1 with respect to the valve needle 20 and the valve body 10 towards the first position during the closing event of the valve assembly 1. When it has reached the first position again, the armature 30 hits the flange 220 of the valve needle 20 with a second kinetic energy thereby transferring energy to the valve needle 20 and exerting a certain force on the valve needle 20 in the first direction D1.

Since some of the first kinetic energy has been dissipated during the movement from the first to the second position, the second kinetic energy has a smaller value than the first kinetic energy. Therefore, the energy transferred to the valve needle 20 during the armature-needle bounce is particularly low. In particular, it is insufficient to overcome the bias of the spring 50 in the second direction D2, so that the needle 20 does not move out of the closing position and the nozzle 130 remains sealed.

The invention is not limited to specific embodiments by the description on basis of these exemplary embodiments. Rather, it comprises any combination of elements of different embodiments. Moreover, the invention comprises any combination of claims and any combination of features disclosed by the claims.

What is claimed is:

1. A valve assembly for a fuel injector comprising a valve body having a longitudinal axis, a valve needle, an armature and an elastic member, the valve needle and the armature being axially movable with respect to the valve body in a first direction and in a second direction, opposite the first direction, wherein:

the armature is biased in the first direction by the elastic member, the needle, when moving in the second direction to a closing position, is operable to mechanically interact with the armature to move the armature in the second direction to a first position against the bias of the elastic member, the armature is axially moveable with respect to the needle such that, when the needle is in the closing position, the armature is movable from the first position further in the second direction to a second position against the bias of the elastic member, the elastic member has a plurality of beams, each beam having a first end and a second end which are axially and radially offset with respect to each other, the armature is operable to reduce the axial offset between the first end and the second end when moving from the first to the second position, the elastic member radially surrounds the needle and is formed such that the first ends of the beams are facing the needle and are arranged at a radial distance from the needle when the armature is in the first position, and the beams are elastically deformable such that the radial distance between the first ends and the needle decreases when the armature moves from the first to the second position.

2. The valve assembly of claim 1, wherein the elastic member is made from stainless steel.

3. The valve assembly of claim 1, wherein at least one of the first ends abuts the needle when the armature is in the second position.

4. The valve assembly of claim 1, wherein the beams are arranged evenly spaced around the needle in a top view along the longitudinal axis.

5. The valve assembly of claim 1, wherein the elastic member has the basic shape of a conical shell with an upper inner edge and a lower outer edge, the upper inner edge facing the armature and the lower outer edge residing against the valve body or vice versa.

6. The valve assembly of claim 5, wherein the upper inner edge is discontinuous and is formed by the first ends of the beams.

7. The valve assembly of claim 6, wherein the elastic member has a circumferential ring section, the ring section comprises the lower outer edge, and the beams are anchored to the ring section at their second ends.

8. The valve assembly of claim 1, wherein the elastic member is provided to bias the armature with a force in the first direction, the force being independent of an axial position of the armature.

9. The valve assembly of claim 1, wherein the elastic member dissipates kinetic energy of the armature when the armature is moving from the first towards the second position by mechanical interaction with at least one of the armature, the needle, and the fuel.

10. A fuel injector comprising:

a valve assembly comprising a valve body having a longitudinal axis, a valve needle, an armature and an elastic member, the valve needle and the armature being axially movable with respect to the valve body in a first direction and in a second direction, opposite the first direction, wherein:

the armature is biased in the first direction by the elastic member, the needle, when moving in the second direction to a closing position, is operable to mechanically interact with the armature to move the armature in the second direction to a first position against the bias of the elastic member, the armature is axially moveable with respect to the needle such that, when the needle is in the closing position, the armature is movable from the first position further in the second direction to a second position against the bias of the elastic member, the elastic member has a plurality of beams, each beam having a first end and a second end which are axially and radially offset with respect to each other, the armature is operable to reduce the axial offset between the first end and the second end when moving from the first to the second position, the elastic member radially surrounds the needle and is formed such that the first ends of the beams are facing the needle and are arranged at a radial distance from the needle when the armature is in the first position, and the beams are elastically deformable such that the radial distance between the first ends and the needle decreases when the armature moves from the first to the second position.

11. A valve assembly for a fuel injector comprising a valve body having a longitudinal axis, a valve needle, an armature and an elastic member, the valve needle and the armature being axially movable with respect to the valve body in a first direction and in a second direction, opposite the first direction, wherein:

the armature is biased in the first direction by the elastic member, the needle, when moving in the second direction to a closing position, is operable to mechanically interact with the armature to move the armature in the second direction to a first position against the bias of the elastic member, the armature is axially moveable with respect to the needle such that, when the needle is in the closing position, the armature is movable from the first position further in the second direction to a second position against the bias of the elastic member, the elastic member has a plurality of beams, each beam having a first end and a second end which are axially and radially offset with respect to each other, the armature is operable to reduce the axial offset between the first end and the second end when moving from the first to the second position, and the elastic member has a shape of a conical shell with an upper inner edge and a lower outer edge, the upper inner edge facing the armature and the lower outer edge residing against the valve body or vice versa.

12. The valve assembly of claim 11, wherein the elastic member is made of stainless steel.

13. The valve assembly of claim 11, wherein at least one of the first ends abuts the needle when the armature is in the second position.

14. The valve assembly of claim 11, wherein the beams are arranged evenly spaced around the needle in a top view along the longitudinal axis.

15. The valve assembly of claim 11, wherein the upper inner edge is discontinuous and is formed by the first ends of the beams.

16. The valve assembly of claim 15, wherein the elastic member has a circumferential ring section, the ring section comprises the lower outer edge, and the beams are anchored to the ring section at their second ends.

17. The valve assembly of claim 11, wherein the elastic member is provided to bias the armature with a force in the first direction, the force being independent of an axial position of the armature.

18. The valve assembly of claim 11, wherein the valve assembly is configured for dissipating kinetic energy of the armature when the armature is moving from the first towards the second position by means of mechanical interaction of the elastic member with at least one of the armature, the needle, and the fuel.

* * * * *